US011306476B2

(12) United States Patent
Griffith et al.

(10) Patent No.: US 11,306,476 B2
(45) Date of Patent: Apr. 19, 2022

(54) STRUCTURAL GAP FILLER AND RELATED METHOD OF USE

(71) Applicant: Bohning Company, Ltd., Lake City, MI (US)

(72) Inventors: Larry R. Griffith, Lake City, MI (US); Scott M. Billsby, Cadillac, MI (US)

(73) Assignee: Bohning Company, Ltd., Lake City, MI (US)

( * ) Notice: Subject to any disclaimer, the term of this patent is extended or adjusted under 35 U.S.C. 154(b) by 194 days.

(21) Appl. No.: 16/900,358

(22) Filed: Jun. 12, 2020

(65) Prior Publication Data

US 2021/0222422 A1 Jul. 22, 2021

Related U.S. Application Data

(60) Provisional application No. 62/964,263, filed on Jan. 22, 2020.

(51) Int. Cl.
*E04B 1/94* (2006.01)
*E04B 1/68* (2006.01)

(52) U.S. Cl.
CPC ..... *E04B 1/6812* (2013.01); *E04B 1/948* (2013.01)

(58) Field of Classification Search
CPC ..... E04B 1/94; E04B 1/6812; E04B 1/948
USPC ..... 277/652; 52/404.1
See application file for complete search history.

(56) References Cited

U.S. PATENT DOCUMENTS 3,523,493 A * 8/1970 Berry ..... E01C 11/106 404/47
3,653,305 A * 4/1972 Trieste ..... E01D 19/06 277/645
3,919,820 A * 11/1975 Green ..... E04B 1/681 52/471
3,950,912 A * 4/1976 Lundberg ..... E04B 1/82 D25/123
4,067,660 A * 1/1978 Puccio ..... E04B 1/681 404/69
4,128,358 A * 12/1978 Compton ..... E01C 11/08 52/396.04
4,141,189 A * 2/1979 Borjeson ..... E04B 1/6803 52/396.06
4,447,172 A * 5/1984 Galbreath ..... E01D 19/06 52/396.05

(Continued)

FOREIGN PATENT DOCUMENTS

EP 3584381 A1 12/2019

*Primary Examiner* — Paola Agudelo
(74) *Attorney, Agent, or Firm* — Warner Norcross + Judd LLP

(57) ABSTRACT

An elongated gap filler is provided including a first panel and a second panel in a V configuration joined at an apex, a first extension wall extending from the first panel, a first sealer wall extending downward and transversely to the first extension wall, and a second extension wall extending from the second panel. The first sealer wall can seal against a surface of a wall and set a depth of insertion of the first and second panels and first extension wall into a gap between building surfaces, e.g., a wall top and a ceiling or roof. The second extension wall can be arcuate and can bend against the ceiling or roof. The first sealer wall can be arcuate and can bend against a vertical wall surface. The apex can include a U-shaped groove to enhance articulation of the panels. A related method of use also is provided.

20 Claims, 6 Drawing Sheets

(56) References Cited

U.S. PATENT DOCUMENTS

| | | | | | |
|---|---|---|---|---|---|
| 4,615,161 | A * | 10/1986 | Mileham | E01C 23/021 | 404/69 |
| 4,746,129 | A * | 5/1988 | Puccio | E01D 19/06 | 277/921 |
| 5,035,533 | A * | 7/1991 | Brown | E01D 19/06 | 404/64 |
| D432,671 | S * | 10/2000 | Grosfillex | D25/119 | |
| 7,240,905 | B1 * | 7/2007 | Stahl, Sr. | E04B 1/948 | 277/933 |
| 7,513,082 | B2 * | 4/2009 | Johnson | E04B 2/7412 | 52/241 |
| 8,375,666 | B2 | 2/2013 | Stahl, Jr. et al. | | |
| 8,671,632 | B2 | 3/2014 | Pilz et al. | | |
| 9,435,114 | B1 * | 9/2016 | Preston | E04B 1/6803 | |
| 10,246,871 | B2 | 4/2019 | Pilz | | |
| 10,851,542 | B2 * | 12/2020 | Hensley | E04B 1/6812 | |
| 11,111,666 | B2 * | 9/2021 | Pilz | E04B 2/7409 | |
| 2006/0032163 | A1 * | 2/2006 | Korn | E04B 1/68 | 52/241 |
| 2017/0234004 | A1 | 8/2017 | Pilz | | |

* cited by examiner

STRUCTURAL GAP FILLER AND RELATED METHOD OF USE

BACKGROUND OF THE INVENTION

The present invention relates to a structural gap filler, and more particularly to a gap filler that is disposed between adjacent structures to inhibit the spread of sound, fire, smoke and other things through a gap between the adjacent structures.

In the construction of buildings, walls typically extend between a floor and a ceiling in a room or other space. In many construction projects, where a wall, floor or ceiling abuts another wall, floor or ceiling, a joint or gap sometimes is created. This is many times the case in commercial construction, where a building shell or a number of structural floors are first constructed. After construction of the shell or floors, walls are built to subdivide the shell or each floor into multiple rooms. The walls typically include a bottom plate that is fastened to the floor. The walls extend upward toward a ceiling. The walls also include a top plate or top that is placed close to the ceiling. To facilitate raising or tilting of a built wall into place under the ceiling, walls are constructed slightly shorter than the distance between the floor and ceiling so that the top plate does not engage the ceiling as a wall is raised to a vertical configuration.

Due to the shortness of the walls relative to the distance between the floor and ceiling, an opening is produced above the wall, below the ceiling. Most fire and other building codes require this opening to be filled with a fire retardant, fireproof and/or sound deadening material. Frequently, these materials are applied in liquid, semi-liquid or sprayed foam form. An installer usually manipulates a large applicator tube or caulk gun filled with a tube of the material, and aims a nozzle into the opening. The installer activates the tube or gun to squirt or spray a bead or amount of the material into the opening as the installer advances along the opening. The installer must perfectly time and move the nozzle at a constant rate to ensure the bead is of a uniform size so material is not wasted, and so enough material fills the opening to seal it between the wall and ceiling.

In most cases, the materials are applied with a large tube or caulk gun, as mentioned above. These applicators are large, bulky and unwieldy, particularly when the installer installs the material in an opening overhead, along a very long wall, or along multiple walls for multiple times during a workday. Further, after the materials set, the excess applied material must be removed to provide a finished appearance of the filler and adjacent walls. For example, the material may need to be cut and sometimes sanded away to smooth it flush with the adjacent wall or ceiling so that wall coverings or flooring can be applied. In addition, when the material is hand applied and is semi-flowable upon application, the material often drips or runs down walls. It also can coat or otherwise fill gaps intended for wiring, plumbing and/or HVAC ducting. This can create a lot of extra work to remove the extra material.

Accordingly, there remains room for improvement in the field of fillers to seal or fill the openings between adjacent walls, ceilings or panels in construction projects.

SUMMARY OF THE INVENTION

An elongated gap filler is provided including a first panel and a second panel in an angled or curved configuration joined at an apex, a first extension wall extending from the first panel, a first sealer wall extending transversely to the first extension wall, and a second extension wall extending from the second panel. The first sealer wall can engage a surface of a wall and set a depth of insertion of the first and second panels and first extension wall into a gap between building surfaces, e.g., a wall and a ceiling or roof or another wall. The elongated gap filler can be easily and precisely installed between a variety of building structures to seal a respective gap therebetween.

In one embodiment, the second extension wall can be arcuate and can bend against a ceiling or roof. The second extension wall and second panel can yield or move relative to the first extension wall to accommodate a variety of different sized gaps so that the gap filler can be used in many applications.

In another embodiment, the apex can include a U-shaped groove to enhance articulation of the panels and/or compression of the gap filler. The U-shaped groove can be defined by an apex projection that extends from the first and second panels opposite a V-shaped or other shaped void defined between those panels. In some cases, this groove can provide extra expansion or compression of the first and second panels relative to one another to adequately fill a gap.

In still another embodiment, the first sealer wall can extend downward from a distal end of the first extension wall. The first sealer wall can include a first sealer wall inner surface that can face and/or engage a building wall outer surface. In some applications, the first sealer wall can be curved or arcuate in shape so it can resiliently deform upon engagement with the building wall outer surface and seal a distal end of the first sealer wall against the building wall outer surface.

In even another embodiment, the second extension wall can be arcuate in shape, extending upward from a second panel distal end. In some applications, the second extension wall can resiliently deform upon engagement with a building horizontal surface spaced adjacent the gap. The second extension wall can seal a distal end of the second extension wall against the building horizontal surface.

In yet another embodiment, the apex, first panel, first extension wall, second panel and second extension wall can be configured to fit within the gap between adjacent building structures and fill that gap. In some cases, these elements fit within a gap between a wall upper end adjacent a ceiling or roof (referred to interchangeably as ceiling herein). In other cases, these elements fit within a gap between adjacent walls. In yet other cases, these elements can fit between a vertical building structure and a horizontal building structure.

In a further embodiment, the first extension wall can extend a first distance from the first panel distal end, and the second extension wall can extend a second distance from the second panel distal end. The ratio of the second distance to the first distance can be at least 2:1. The second extension wall can be configured to engage a generally horizontal surface that extends above an upper portion of a wall, well beyond a vertical surface of the wall that is engaged by the first sealer wall.

In still a further embodiment, the second extension wall can be placed above the first extension wall when the gap filler is placed in a gap. The second extension wall can extend a greater distance from the second panel than the first extension wall extends from the first panel so that the second extension wall is longer than the first extension wall relative to a reference line taken through the apex.

In still yet a further embodiment, the gap filler can include an elongated filler strip disposed between the first extension wall and the second extension wall. This filler strip can be constructed from a fire retardant, fire proof and/or sound deadening material to further enhance the isolation functionality of the gap filler placed in a gap.

In still yet a further embodiment, a method of installing an elongated gap filler is provided. The method can include placing an elongated gap filler in a gap between a first surface and a second surface of a building structure such that a first panel and a second panel in a V configuration are within the gap, and such that a first extension wall extending at an obtuse angle from a distal end of the first panel is adjacent the first surface and such that a second extension wall extending from a distal end of the second panel is adjacent the second surface; placing a first sealer wall extending transversely from the first extension wall against a third surface of the building that is substantially perpendicular to the first surface with the first sealer wall at least impairing the first and second panels from being inserted too far into the gap between the first and second surfaces; and moving the first and second panels relative to one another so that the first and second panels at least one of move toward one another and move away from one another to fit within the gap between the first surface and the second surface. The method can further include applying a wall covering to the first sealer wall so that the first sealer wall melds into the third surface.

In even a further embodiment, the method can be used where the first surface is an upper portion of a vertical wall, where the second surface is a horizontal surface above the vertical wall, spaced from the upper portion of the vertical wall by the gap, and where the third surface is a vertical surface of the vertical wall. The applying step can include applying a filler material over a lower edge of the first sealer wall and over the vertical surface. The second extension wall can be arcuate and can bend when the second extension wall is placed adjacent the horizontal surface.

The current embodiments of the gap filler and related method of installation provide benefits in sealing or filling gaps between adjacent building structures that previously have been unachievable. For example, the elongated gap filler can be rapidly installed within gaps overhead, down low, or in difficult to reach locations in a building. The elongated gap filler can include the V configuration and/or the supplemental bead at the apex to allow the filler to compress or expand within a gap and adequately seal against the adjacent surfaces. Where the extension or sealer walls are arcuate or include a radius, these elements can be resiliently deformed and/or sealed against surfaces adjacent the gap to enhance such sealing or engagement. Where the volume between the panels and/or extension walls is filled with an additional material filler, the gap filler can further reduce sound transfer.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
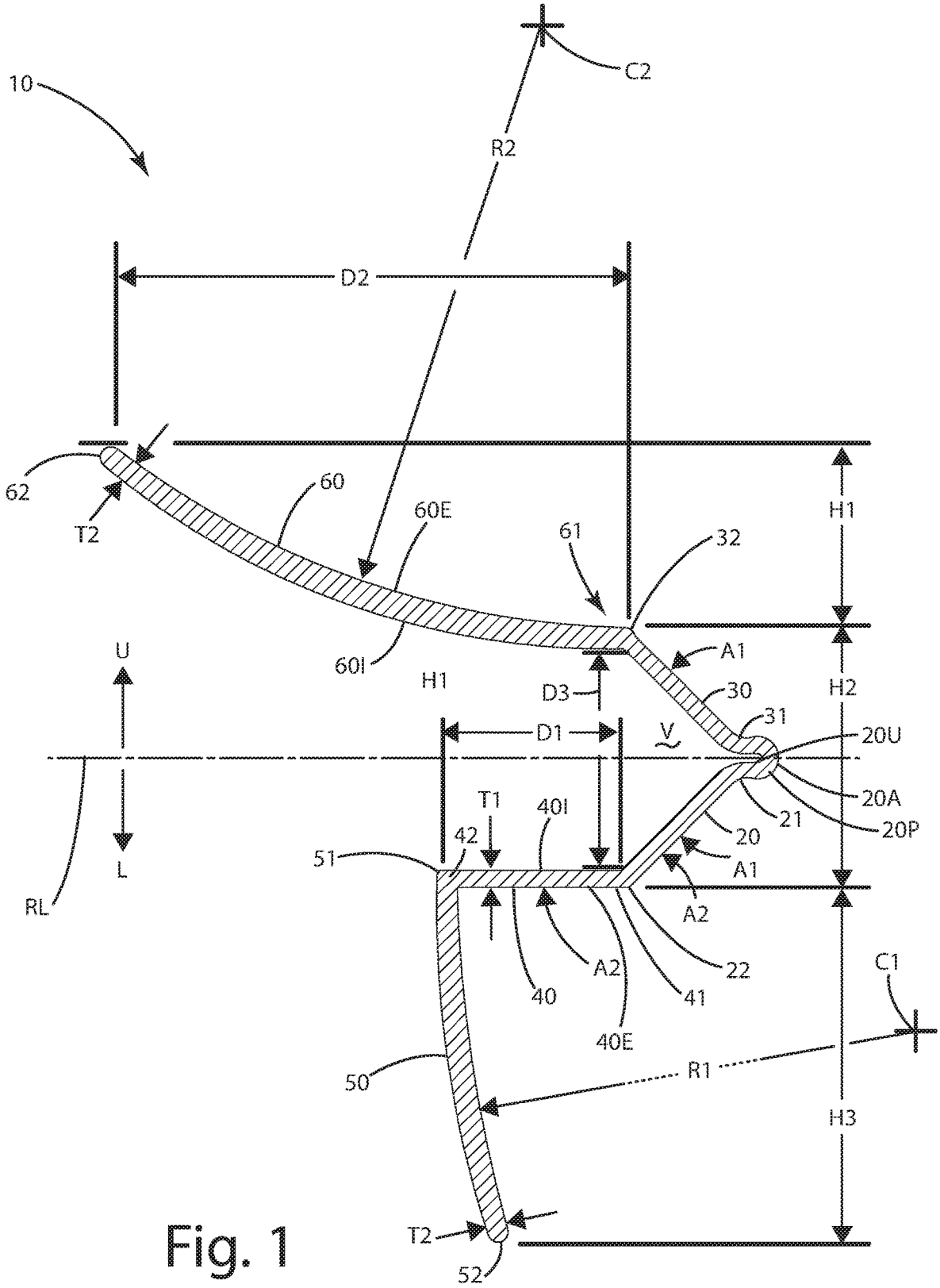
FIG. 1 is an end view of the gap filler of a current embodiment.
Figure 2:
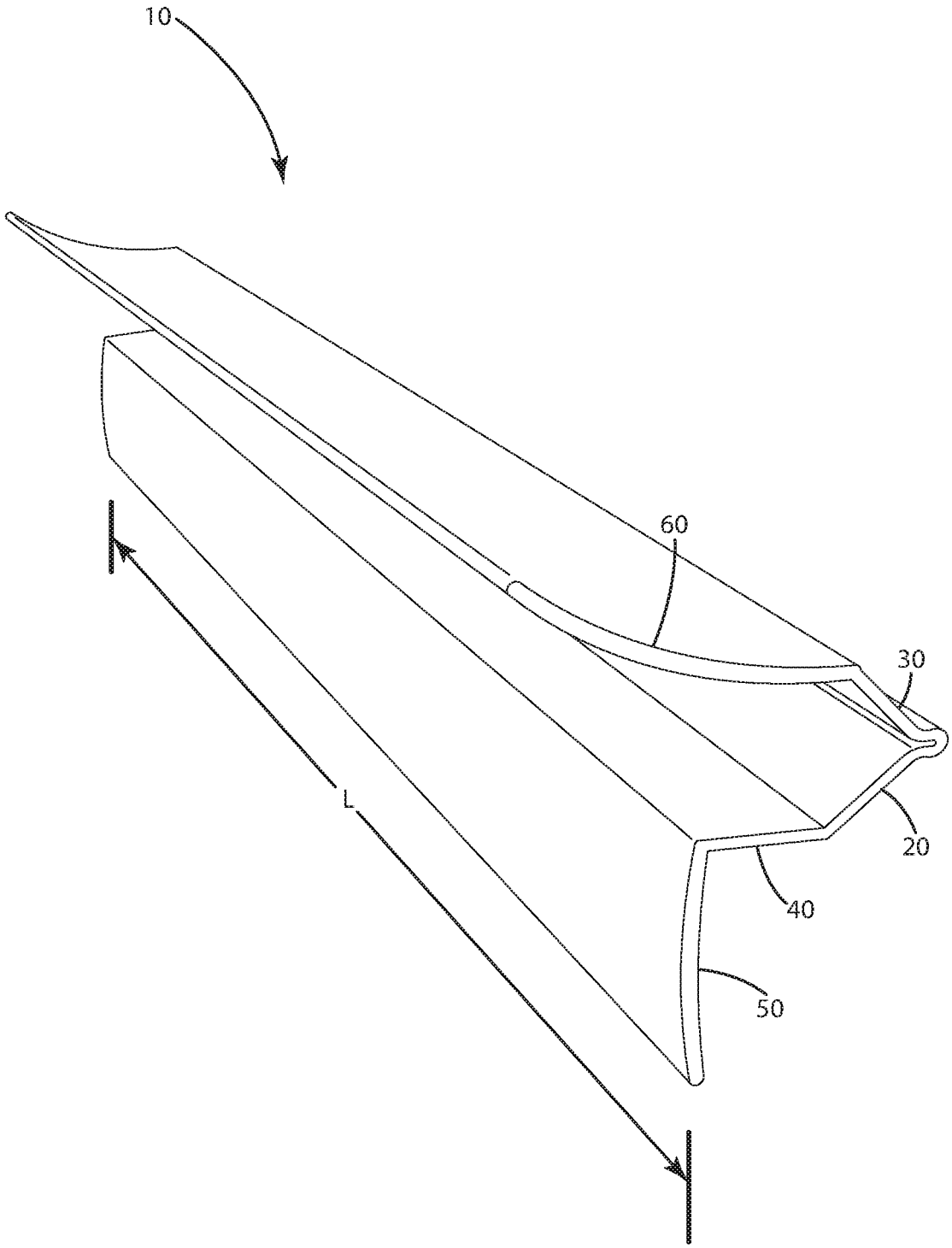
FIG. 2 is a perspective view of the gap filler.

A current embodiment of the gap filler is illustrated in FIGS. 1-5, and generally designated 10. The gap filler can be in the form of an elongated structure. As shown in FIG. 2, this elongated structure and have a length L. This length L can be of any predetermined length suitable for fitting between adjacent building structures, such as walls, ceilings, floors, roofs, etc. The predetermined length L can be optionally at least 1 foot, at least 2 feet, at least 3 feet, at least 4 feet, at least 6 feet or greater or lesser lengths, depending on the application and the length of the gap to be filled in, sealed or otherwise closed. The gap filler 10 can include a first panel 20 and a second panel 30. The first panel 20 can transition to a first extension wall 40 which itself can transition to a first sealer wall 50. The second panel 30, which is shown disposed above the first panel 20, extension wall 40 and first sealer wall 50, can be joined with a second extension wall 60. This second extension wall 60 can extend outwardly and in an arcuate manner away from the distal end 32 of the second panel 30 as described below.

Figure 4:
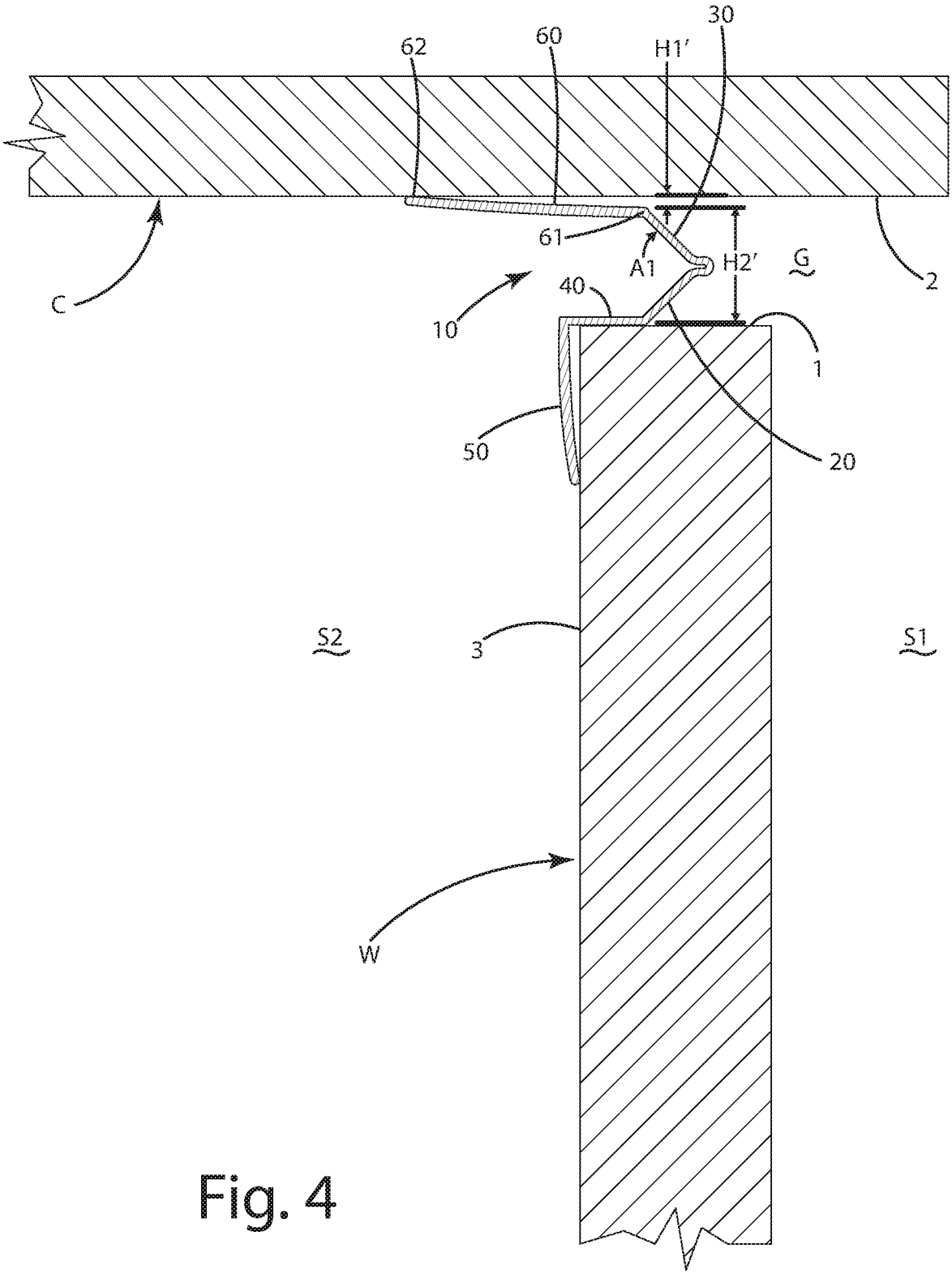
FIG. 4 is a section or end view of the gap filler installed in the gap.
Figure 5:
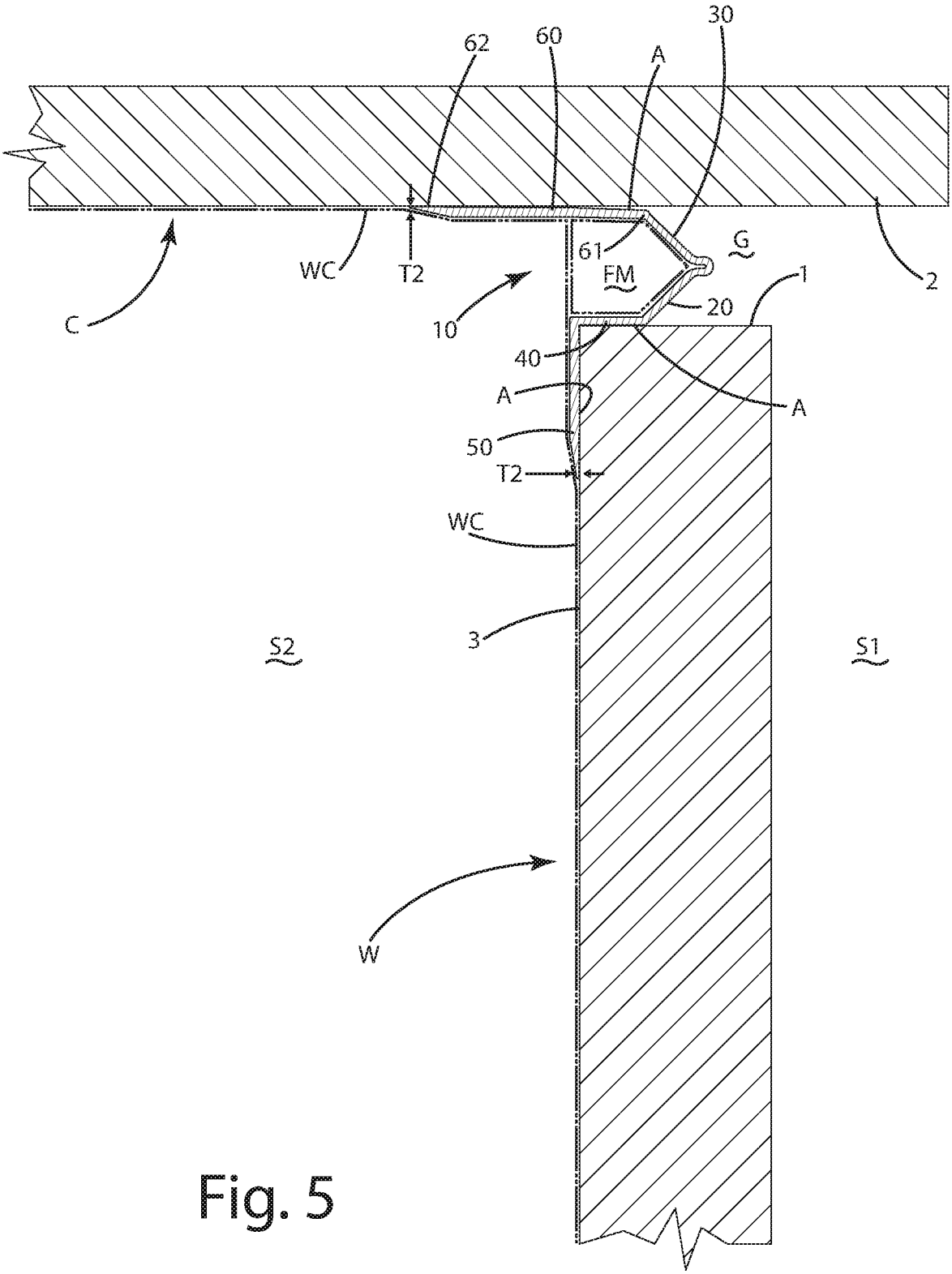
FIG. 5 is a section or end view of the gap filler being sealed and covered partially with a wall covering.

As shown in FIGS. 4-5, the gap filler 10 can be disposed between a first building surface 1 and a second building surface 2 to fill in, occlude, or partially or fully obstruct a gap G between the first surface 1 and the second surface 2. As shown, the first surface 1 can be an upper portion of a wall W, and the second building surface 2 can be a horizontal surface, such as that of a ceiling or a roof or other generally horizontal structure C in a building. Of course, in other applications as described below, the gap G can be formed between other building surfaces.

The gap filler 10 can be constructed from a variety of materials such as polymers, composites, metals and combinations thereof. In the embodiment illustrated, the gap filler can be extruded piece of polymeric material. This polymeric material can be a fire resistant or fire retardant thermoplastic urethane (TPU). Of course, other types of polymeric materials can be used. These polymeric materials can be resistant to fire and/or thermal degradation or generally can burn at very slow rates. These polymeric materials can include polar monomers and/or hydrogen bonding between polymer chains to enhance fire resistance. The polymers optionally can incorporate aromatic cycles or heterocycles, polyimides, polybenzoxazoles, polybenzimidazoles, and polybenzthiazoles are some examples of polymers suitable for the gap filler. The polymeric material can be a ladder polymer, which links to polymer chains with periodic covalent bonds, or can be a single chain that is double-stranded. Further optionally, the polymeric material can include an inorganic and/or semi-organic polymer having silicon-nitrogen, boron-nitrogen and/or phosphorus-nitrogen monomers. Further optionally, the polymeric material can include a flame retardant additive filler. Examples of such an additive can include aluminum, phosphorus, nitrogen, antimony, chlorine, bromine, and in some cases magnesium, zinc and/or carbon. In some cases, where the gap filler is constructed from a comp that composite can include natural fibers that are fire retardant. In other cases, the gap filler can be constructed from nano composites, carbon fibers another carbon based materials. In yet other cases organic modified clays, titanium dioxide, nanoparticles, silica nanoparticles, layered double hydroxides, carbon nanotubes and polyhedral silsesquioxanes can be incorporated into and/or form the gap filler.

Optionally, the gap filler can be constructed via extrusion. This can enable the gap filler to be produced in elongated form and in a continuous, repeatable manner. Such extrusion also can facilitate manufacture of long pieces of the gap filler, which optionally can be cut to custom or standard lengths for a particular job. These long pieces of gap filler also can be rolled into rolls where the gap filler material is flexible. Of course, in other applications, the elongated gap filler can be constructed via injection molding, pour molding with other techniques.

With further reference to FIGS. 1-2, the gap filler 10 can include a first panel 20 and a second panel 30. These panels can be joined together in an angled or curved configuration, such as a V-shape configuration or a U-shape configuration and/or a channel configuration, all of which are considered a V configuration herein. The panels 20 and 30 can be disposed at an angle A1 relative to one another. This angle A1 can be optionally between 10° and 90°, inclusive, between 20° and 80°, inclusive, between 30° and 70°, inclusive, between 40° and 60° inclusive, between 60° and 90°, inclusive, between 85° and 95°, inclusive, between 88° and 92°, inclusive, or about 90°. The first panel 20 and the second panel 30 can be joined at an apex 20A and can flex toward and/or away from one another about that apex 20A. In some cases, the angle A1 can open up greater than the configuration shown in FIG. 1 to an angle that is 10%, 20%, 30%, 40% or 50% greater than the angle A1 noted above to adequately fill in a gap.

The first panel 20 can include a first or proximal end 21 and a second or distal end 22. Likewise the second panel 30 can include a first or proximal end 31 and a second or distal end 32. The proximal end of the first panel 21 can be adjacent and/or directly or indirectly joined with the proximal or first end 31 of the second panel 30.

Optionally, the apex 20A can include a groove 20U defined at the apex 20A. In particular, this groove or channel 20U can be defined by an apex projection 20P that extends from the first and second channels, opposite the void V defined between the first 20 and second 30 panels. This apex projection 20P can be formed from extensions of the respective first and second panels at the proximal ends thereof. In some cases, the apex projection 20P can be in the form of a channel and have a C- or V- or U-shape such that a corresponding groove faces and opens to the void V defined between the first panel and the second panel. Optionally, the groove 20U can include a radius, which can be less than 0.1 inches, less than 0.08 inches, or about 0.063 inches.

As shown in FIG. 1, the gap filler 10 can include a reference line RL that extends through the apex 20A, generally bisecting the gap filler 10 into upper U and lower L portions. As shown, the gap filler 10 can be of an asymmetric configuration about the reference line RL, with only the first and second panels 20 and 30, and the apex projection 20P being symmetric about that reference line RL, and the remaining features of the gap filler 10 being asymmetric and/or dissimilar about that reference line RL in the respective upper and lower portions. As shown, the first 20 and second 30 panels can be of similar and/or identical lengths. Where of identical lengths, the first and second panels can extend upwardly and downwardly respectively from the reference line RL equal distances.

Each of the first and second panels also can extend to their respective distal ends 22 and 32 the same distance from the apex 20A. Optionally, these ends 22 and 32 can be separated from one another by a height H2. This height H2 can be less than, equal to or greater than the gap G within which the gap filler 10 is to be placed. In some cases, the height H2 can be slightly greater than the gap G so that the panels 20 and 30 are resiliently compressed such that the distal ends 22 and 32 engage the respective surfaces forming the gap G. The height H2 can be any height, depending on the gap to be filled, but can be optionally about ¼ inch, ½ inch, ⅔ inch, ¾ inch, 0.755 inch, 1 inch, 2, inches, 3 inches, 4 inches or other heights.

At the distal end of the first panel 20, the first panel can transition to the first extension wall 40. This first extension wall 40 can be joined at its proximal end 41 to the distal end 22 of the second panel 20, and can extend to a distal end 42. The first extension wall 40 can include an inner surface 401 and an exterior surface 40E. The inner surface 401 can face toward the reference line RL and toward the second extension wall 60. Optionally, the thickness T1 of the first extension wall, the first panel and the second panel can be substantially equal. In some cases, this thickness T1 can be optionally 0.01 inches to 0.25 inches, inclusive, about 0.05 inches, 0.10 inches to 0.2 inches, inclusive, or 0.05 inches to 0.125 inches.

As shown, the first extension wall 40 can extend a distance D1 parallel to the reference line RL away from the first panel 20. For this distance, the inner surface 401 and the first extension panel 40 can be generally parallel to the reference line RL. This distance D1 can optionally be at least ¼ inch, at least ½ inch, about 0.555 inch, at least 1 inch, at least 1.5 inch, at least 3 inches, at least 5 inches, or greater depending on the application. This first extension wall also can extend at an obtuse angle A2 relative to the first panel 20. This obtuse angle A2 can be optionally greater than 90°, between 91° and 170°, inclusive, between 90° and 150°, inclusive, between 110° and 145° inclusive, or about 145°. Of course, other angles can be selected as desired. Optionally, the inner surface 401 and the inner surface 601 can be spaced a distance D3 from one another at the proximal ends 41 and 61 respectively, where that distance is less than the height H2 as mentioned above. In some cases this height H2 can be equal to the thickness T1 times 2, plus the distance between the inner surface 401 and the inner surface 601.

The first extension wall 40 can include a first extension wall exterior surface 40E configured to face toward a first surface 1 of a first building structure. For example, as shown in FIG. 4, the exterior surface 40E can be configured to face toward a building wall W upper portion or surface 1 and contact that first surface 1 directly when the gap filler 10 is placed within the gap G. The first extension wall 40 can include the first extension wall inner surface 401 that can be configured to face toward inner surface 601 of the second extension wall 60. Opposite that inner wall 601 can be an exterior surface 60E. This exterior surface 60E can be configured to face toward a second surface 2, for example a horizontal surface, such as a building ceiling C as shown in FIG. 4. Indeed, the respective extension walls can engage the respective surfaces 1 and 2 as described below.

As further shown in FIG. 1, the second extension wall 60 can extend a distance D2 away from the second panel 30, and generally from the distal end 32 of the second panel. This distance D2 can be measured parallel to the reference line RL. Distance D2 can be greater than the distance D1 by which the first extension panel 40 extends away from the second panel. This distance D2 can be optionally at least 1 inch, at least 1.5 inches, about 1.50 inches, about 1.460 inches, at least 2 inches, at least 3 inches or other distances depending on the application. This distance D2 can be in a ratio relative to D1, for example, the ratio D2:D1 can be at least 2:1, at least 3:1, at least 4:1 or other ratios depending on the application. The second extension wall also can include a proximal end 61 and a distal end 62. The proximal end 61 can be disposed a height H1 below the distal end 62. This height H1 can be less than the distance D2 from which the distal end 62 extends away from the distal end 32 of the second panel 30. The ratio of the height H1 to the distance D2 can optionally be one at least 1:2, at least 1:3, at least 1:4, at least 1:5 or other ratios depending on the application.

Optionally, the second extension wall 60 can taper or curve or angle away from the reference line RL, while the first extension wall 40 can extend generally parallel to the reference line RL. As an example, the second extension wall 60 can include a radius of curvature R2 that is centered upon a center C2 of a circle. The center C2 can be disposed above the reference line RL, generally above the second panel 30 and the apex 20A. This radius R2 can be optionally between 1 inch and 8 inches, inclusive, between 1 inch and 5 inches, inclusive, between 2 inches and 4 inches, inclusive, or about 2.28 inches. Further optionally, the first sealer wall 50, as described below, can include a radius of curvature R1 that is centered on a center C1. That center C1 can be disposed below the reference line RL, generally below the apex 20A. This radius R1 can be greater than radius R2. This radius R1 can be optionally between 1 inch and 8 inches, inclusive, between 1 inch and 5 inches, inclusive, between 2 inches and 4 inches, inclusive, or about 3.026 inches. Of course, these centers can be moved above and/or below the reference line RL depending on the application and the radius of curvature of each of these elements. The second extension wall 60 can be arcuate, curved or arched generally upward, and away from the reference line RL. Generally, the wall 60 can be convex toward the reference line RL. In other embodiments, the second extension wall 60 can be angled at a variety of steps upward and away from the reference line, depending on the application. With this curvature or angling of the second extension wall 60 away from the reference line RL, this element can be somewhat resilient and bendable and flexible so that its distal end 62, when placed against a surface, such as a second surface 2, can bend toward the reference line RL, yet maintain the distal end 62 in contact with the horizontal surface 2 as described below. In some cases, the height H1 can be reduced to almost 0.

Optionally, the distal end 62 can be thinned to a second thickness T2 that is less than, greater than or equal to the first thickness T1 of the second panel 30, the first panel 20 and/or the first extension wall 40. The second thickness T2 can be very thin so that the structure at the distal end 62 melds into and cleanly transitions to an adjacent horizontal or other second surface 2. This can enable a wallcovering WC such as paint, coating, wallpaper, drywall, film or other material to be placed over the distal end 62 without forming a substantially noticeable line or edge at that location. Similarly, the first sealer wall 50 can include such a second thickness T2 that is tapered toward a distal end 52 of that first sealer wall 50 as described below. As an example of this tapering, the first sealer wall 50 can taper from a first thickness T1 to a lesser second thickness T2 generally from the proximal end 51 to the distal end 52 of the first sealer wall 50. The first extension wall 40 optionally can transition from a first thickness T1 to a lesser second thickness T2 of the first sealer wall 50, which thickness T2 can start at the proximal end 51 or near it. In other applications, the thickness T2 optionally can be greater than the thickness T1. For example, thickness T1 can be about 0.050 inches and thickness T2 can be about 0.060 inches. The sealer walls can be of that greater thickness T2 starting at the proximal ends 51, 61, and those sealer walls can be of a uniform thickness T2 from those ends to the respective distal ends.

As shown in FIG. 1, the first and second extension walls can extend away from the respective first and second panels and can be spaced from the reference line RL that extends through the apex 20A. The first extension wall 40 can extend parallel to that reference line RL for the distance D1. The second extension wall 60 can extend somewhat parallel to that reference line RL near the second panel 30 for a short distance, but then can taper upward. In some cases, the second extension wall 60 can extend parallel to the reference line RL for the same or a similar distance D1 as the first extension wall 40 as described in an alternative embodiment below.

The first sealer wall 50 can be joined with the distal end 42 of the first extension wall 40. The first sealer wall 50 can extend generally perpendicular to the first extension wall 40 and downward, away from the reference line RL, which optionally can be in the form of a reference plane through which the reference line extends along the length L of the gap filler 10. As mentioned above, the first sealer wall 50 can be of an arcuate or curved shape as shown, extending downward, away from the reference line RL or plane and the first extension wall 40. The first sealer wall 50 can extend downward from the first extension wall 40 by a distance H3. This distance H3 can be greater than the height H2 of the first and second panels 30 and 40, and optionally greater than the height H1 of the second extension wall 60. In some cases, the height H2 can be taken between the exterior surface 60E at the proximal end 61 and the exterior surface of panel 40 at proximal end 41. The height H2 can be in a ratio to H3, the ratio H2:H3 optionally being about 3:4; 1:2, 2:3, 1:1 or other ratios. The height H3 can be optionally 0.25 inches to 2.00 inches, inclusive, 0.5 inches to 1.5 inches inclusive, 0.75 inches to 1.25 inches, 0.5 inches to 1.00 inches, inclusive, about 1.00 inches, about 1.03 inches, or other heights, depending on the application and the amount of overlap of an adjacent building surface 3, for example, a vertical surface of a wall W. This first sealer wall 50 can be arcuate as mentioned above. Optionally, it can be resilient and can bend when the distal end 52 engages a third surface 3, which can be substantially perpendicular to the first surface 1 as shown in FIG. 4. This first sealer wall 50 can at least impair the first 20 and second 30 panels from being inserted too far into the gap G between the first 1 and second 2 surfaces.

A method of installing gap filler will now be described with reference to FIGS. 1-5. The gap filler can be installed between a first building structure W and a second building structure C. The first building structure W optionally can be a vertical wall or vertical surface having a vertical third surface or outer surface 3. The second building structure C optionally can be a ceiling or horizontal surface having a second surface 2. The wall W also can include a first surface 1 that is formed in an upper portion of the wall W. The gap G can be formed vertically between the first surface 1 and the second surface 2.

Figure 3:
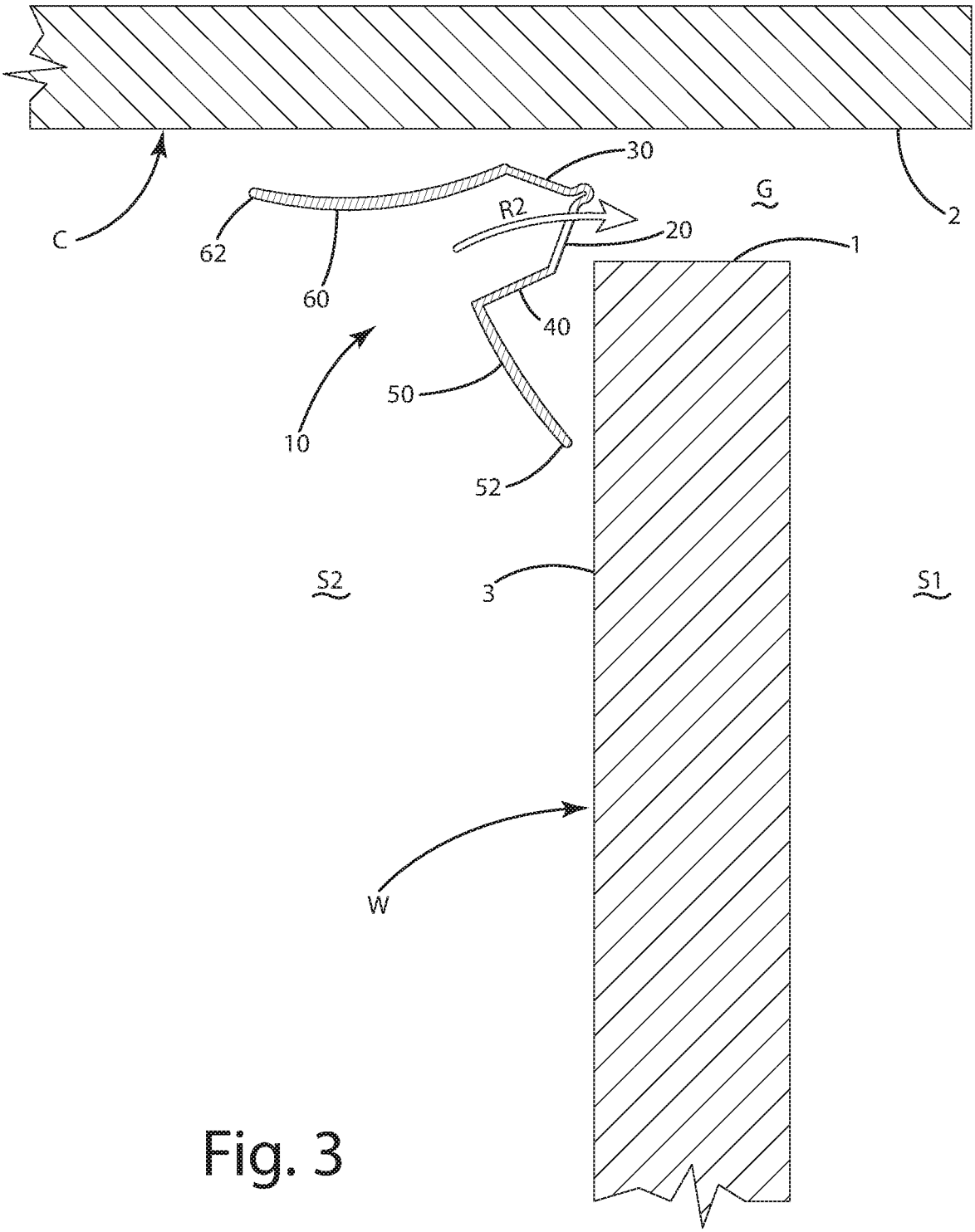
FIG. 3 is a section or end view of the gap filler being installed in a gap between adjacent building structures.

The gap filler 10 in FIG. 3 can be tilted in direction R2 and inserted into the gap G. Upon the insertion, the distal end 52 of the first sealer wall 50 can engage the third surface 3. The first sealer wall 50 can resiliently deflect and/or slightly bend upon such engagement, changing from the arcuate shape as shown to a less arcuate or straighter shape. The distal end 62 of the second extension wall 60 can engage the second surface 2 of the ceiling C. As a result, the second extension wall 60 can resiliently deflect and/or slightly bend upon such engagement, changing from the arcuate shape as shown to a less arcuate or straighter shape. The first 20 and second 30 panels can be inserted into the gap G. The first extension wall 40 can engage and/or slide against the first surface 1. Portions of the second extension wall 60 also can slide and/or engage the second surface 2 during the insertion of the gap filler 10 into the gap G.

As shown in FIG. 4, the gap filler 10 can be almost fully installed in the gap G. In this configuration, the second extension wall 60 can be straightened substantially from its arcuate shape, with the distal end 62 engaging the second surface 2. The height H1 of that second extension wall 60 can be reduced to a second, lesser height H1'. The first 20 and second 30 panels can be bent or deflected slightly toward one another such that they moved toward one another. The angle A1 can also be changed to a lesser angle A1' when such bend occurs. The U-shaped groove also can compress and close slightly the apex. The height H2 of the panels 20, 30 also can reduce and become a lesser height H2' upon such compression. The first sealer wall 50 can engage and continue to engage the third surface 3. Generally, the first sealer wall, which can extend transversely from the first extension wall, can be placed against the third surface 3 which again is substantially perpendicular to the first surface 1 of the wall. Although shown with a small height H1' between the proximal end 61 of the second extension wall 60 and the second surface 2, this H1' can be zero, particularly where the gap is less than the height H2 of the gap filler 10 in its neutral and uncompressed state. When the gap filler 10 is pushed into the gap G, the panels 20 and 30, as well as the extension walls, can compress toward one another and toward the reference line RL. Again, as the gap filler 10 is inserted into the gap G, the first sealer wall 50 can impair the first and second panels 20, 30 from being inserted too far into the gap G between the first and second surfaces.

With reference to FIG. 5, the gap filler 10 can be fully installed. There, the gap filler 10 optionally can be adhered in place with an adhesive A that is applied to the respective surfaces of the second extension wall 60, the first extension wall 40 and the first sealer wall 50. This adhesive A can secure the first extension wall 42 to the first surface 1, the first sealer wall 52 to the third surface 3 and the second extension wall 62 to the second surface 2. Where included, with an optional taper in the end thickness T2 at the distal end 62 of the second extension wall 60 as well as the and the reduced thickness T2 at the distal end 52 of the first sealer wall 50, these distal ends can meld well and transition without an abrupt edge into the respective surfaces 2 and 3 of the building structures.

Optionally, a wallcovering WC can be applied to the respective surfaces 2 and 3 of the wall W and ceiling C. The wallcovering WC also can extend over portions of the second extension wall 60 as well as the first sealer wall 50. A filler material FM, optionally plaster, drywall, spackle or other material, can be installed between the first extension wall 40 and the second extension wall 60 to fill in that volume. The wallcovering WC also can extend over the filler material FM as shown. Of course, in other applications, the filler material FM might not be installed such that there is a small groove the top of the wall.

With the gap filler 10 installed in the gap G, it can provide sound deadening between the different spaces S1 and S2 on opposite sides of the building structure W. The gap filler 10 also can inhibit, prevent or impair spread of fire between those spaces S1 and S2. Further, the gap filler can prevent debris, materials, matter or other things from being transmitted or transferred from the first space S1 to the second space S2.

Figure 6:
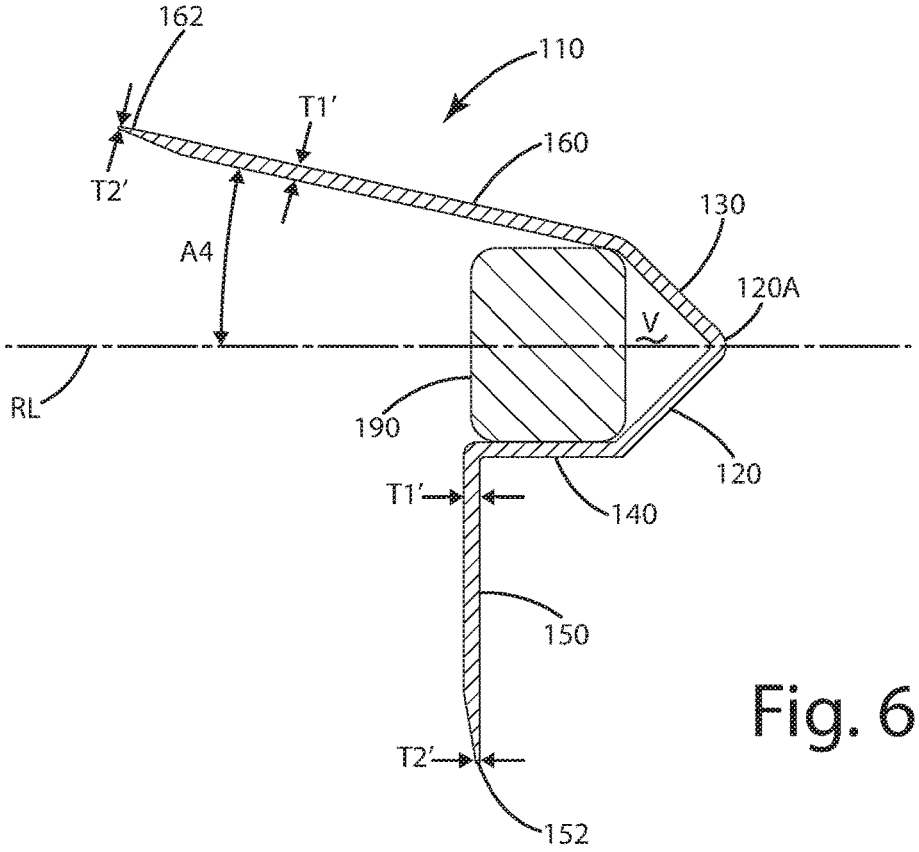
FIG. 6 is a section or end view of a gap filler of a first alternative embodiment including a filler element therein.

A first alternative embodiment of the gap filler 10 is shown in FIG. 6 and generally designated 110. The gap filler can be virtually identical to the gap filler 10 described above in structure, function and operation with a few exceptions. For example, the gap filler 110 can include a first panel 120 and a second panel 130 joined at an apex 120A. This apex 120A as shown does not include a U-shaped groove or an apex projection. The gap filler 110 can include a first extension wall 140 and a second extension wall 160. The first extension wall optionally can be angled and rather straight as illustrated, extending at an angle A4 away from the reference line RL that passes through the apex 120A. The gap filler 110 can include a sealer first sealer wall 150, similar to the one above, except that it can be generally perpendicular to the first extension wall 140 and not of an arcuate shape. The sealer wall 150 can taper from a first thickness T1' to a lesser second thickness T2' at the distal end 152 of the first sealer wall 150. Likewise the second extension wall 160 can taper from a first thickness T1' to a lesser second thickness T2' at the distal end 62 of the second extension wall 160.

This embodiment can optionally include an elongated filler strip 190. The strip 190 can be in the form of a fire retardant, sound deadening, sound reducing, and/or cushion element. In some cases, the elongated filler strip 190 can extend along the entire length L of the gap filler 110. It can extend generally between the first extension wall 140 and the second extension wall 160. The strip can be of a rectangular cross shape as shown, or can be sprayed or otherwise filled within the void V between the first 120 and second 130 panels, as well as the first extension wall 140 and the second extension wall 160. This filler strip can be of other cross-sections, for example, it can be polygonal, circular, elliptical, triangular or of other shapes depending on the amount of compressibility and/or expansion suitable for the gap filler 110. The filler strip 190 can be compressible, such that when the first and second panels move relative to one another, for example, toward one another, and/or the first and second extension walls move relative to one another, for example, closer to one another, the filler strip 190 can compress. In some cases, the filler strip 190 can be constructed from a foam, a polymer, natural fibers, a gel, a viscous material, or combinations of any of the foregoing.

Figure 7:
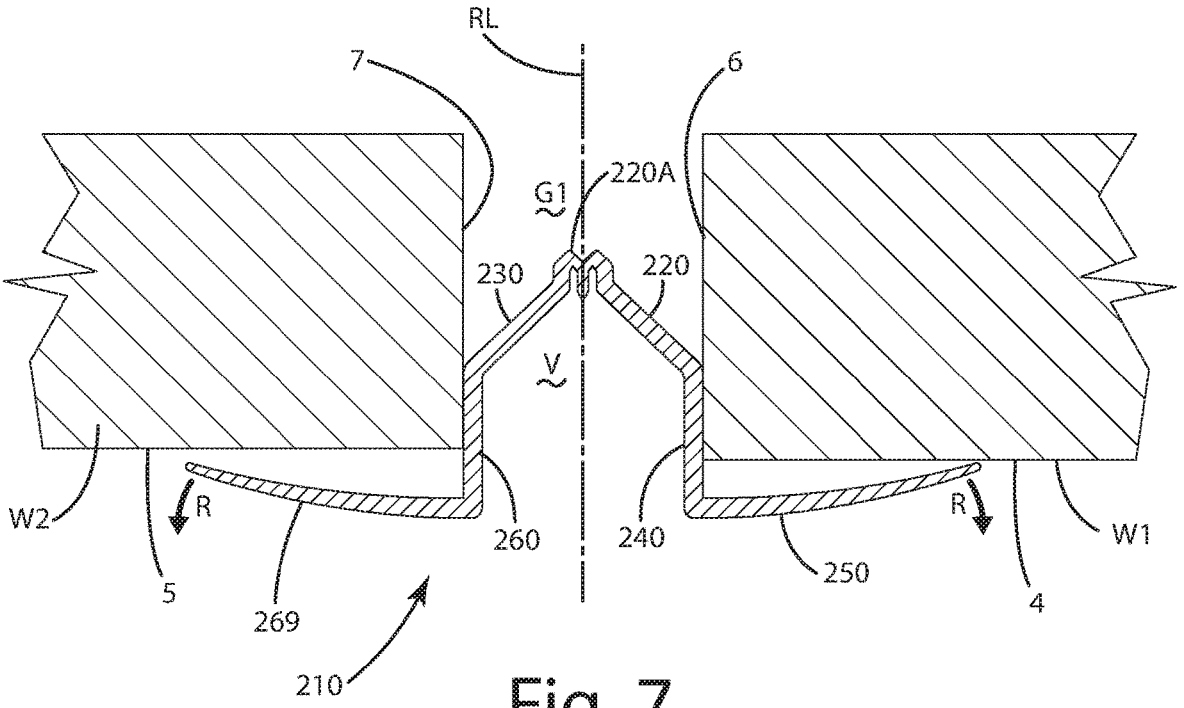
FIG. 7 is a section or end view of a gap filler of a second alternative embodiment installed between adjacent building structures.

A second alternative embodiment of the gap filler is shown in FIG. 7 and generally designated 210. This gap filler can be virtually identical to the gap fillers described above in structure, function and operation with a few exceptions. For example, this gap filler 210 can include a first panel 220 and a second panel 230 that are joined at an apex 220A which may or may not define a U-shaped groove as described above. The panels also can include a first extension wall 240 and a second extension wall 260 that are disposed opposite one another. These walls optionally can be disposed on opposite sides of the reference line RL that extend to the apex 220A. Optionally these extension walls can be parallel to one another. The first extension wall 240 can be joined with a first sealer wall 250, and the second extension wall 260 can be joined with a second sealer wall 269. The first sealer wall 250 and the second sidewall 269 can be similar to the first sealer walls 50 and/or 150 described above. These sealer walls optionally can be arcuate and/or planar, but at an angle with respect to the respective extension walls to which they are joined.

The gap filler 210 can be configured to be placed between adjacent first and second building structures, such as a first wall W1 and a second wall W2. The first and second walls can form a vertical gap G1. The first wall W1 and second wall W2 can be parallel to one another and can include associated surfaces 4 and 5 which form vertical surfaces of the walls. The walls can include surfaces 6 and 7, which are generally parallel to one another and optionally can be vertically oriented as well. The gap filler 210 can be inserted within the gap G1 and pushed between the surfaces 6 and 7. When this occurs, the first 220 and second 230 panels can compress toward one another, as can the first 240 and second 260 extension walls, to fill in the gap G1, with the extension walls engaging the respective surfaces 6 and 7. In so doing, the gap filler 210 can continue to be pushed into the gap G1. Where the sealer walls 250 and 269 are of an arcuate shape, they can resiliently flex or bend in directions R until the sealer walls are flush with respective outer surfaces 4 and 5 of the walls W1 and W2. Optionally, the first and second sealer walls can be coated with an adhesive to engage the surfaces 4 and 5 to secure those sealer walls against the surfaces 4 and 5. The gap filler 210 can be held in place by the adhesive or other fastener. Of course, adhesive can be applied to other parts of the gap filler, for example, to the extension walls and/or the panels, to secure them in place. Afterward, the wallcovering can be applied over the gap filler and its respective components so that the gap is covered.

The various components and features of the embodiments herein, for example, the gap filler and its components, can take on a variety of aesthetic forms, shapes and sizes. Although a particular component or feature can have a function, that feature can be expressed in different aesthetic manners to form an artistic design and/or a purely ornamental design.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z, and/or any other possible combination together or alone of those elements, noting that the same is open ended and can include other elements.

The embodiments of the invention in which an exclusive property or privilege is claimed are defined as follows:

1. An elongated gap filler comprising:

a first panel and a second panel joined in a V configuration so that the first panel and second panel extend transversely relative to one another, the first panel and second panel joined with one another at an apex having a U-shaped groove defined at the apex;

a first extension wall extending from the first panel to a first sealer wall, the first sealer wall extending downward and transversely to the first extension wall; and a second extension wall extending from the second panel upwardly and away from the first extension wall, beyond the first extension wall, wherein the first extension wall extends a first distance from the apex, the first distance taken along a reference line that extends through the apex, wherein the first sealer wall does not extend beyond the first distance, wherein the second extension wall extends a second distance from the apex, the second distance taken along the reference line, wherein the second distance is greater than the first distance.

2. The elongated gap filler of claim 1, wherein the U-shaped groove is defined by an apex projection that extends from the first and second panels opposite a V-shaped void defined between the first and second panels.

3. The elongated gap filler of claim 1, wherein the first extension wall extends at least ½ inch from the first panel and is disposed at an obtuse angle relative to the first panel, with the first extension wall being generally parallel to the reference line, wherein the first extension wall includes a first extension wall inner surface facing toward a second extension wall inner surface of the second extension wall, and a first extension wall outer surface configured to face toward a building wall upper portion.

4. The elongated gap filler of claim 3, wherein the first sealer wall extends downward from a first distal end of the first extension wall, wherein the first sealer wall includes a first sealer wall inner surface configured to face toward a building wall outer surface.

5. The elongated gap filler of claim 4, wherein the first sealer wall is curved rearward so that the first sealer wall can resiliently deform upon engagement with the building wall outer surface and seal a distal end of the first sealer wall against the building wall outer surface.

6. The elongated gap filler of claim 1, wherein the second extension wall is arcuate in shape, extending upward from a second panel distal end, so that the second extension wall can resiliently deform upon engagement with a building horizontal surface spaced from the building wall upper portion and seal a distal end of the second extension wall against the building horizontal surface.

7. The elongated gap filler of claim 1, wherein the apex, first panel, first extension wall, second panel and second extension wall are configured to fit within a gap between adjacent building structures and fill that gap.

8. The elongated gap filler of claim 1 comprising:

an elongated cushion disposed between the first extension wall and the second extension wall, the elongated cushion configured to at least one of reduce noise propagation through the elongated gap filler and inhibit fire spread through the elongated gap filler.

9. The elongated gap filler of claim 8, wherein the second extension wall includes a second extension wall proximal end and a second extension wall distal end, wherein the second extension wall is arcuate between the proximal and distal end, wherein the second extension wall curves upward and away from the reference line from the proximal end toward the distal end, as the second extension wall extends away from the second panel.

10. The elongated gap filler of claim 1, wherein the first sealer wall extends downward away from the first extension wall so as to resiliently engage a vertical building surface, wherein the second extension wall extends upward away from the second panel so as to resiliently engage a horizontal building surface that is gapped from the vertical building surface.

11. An elongated gap filler comprising:

a first panel and a second panel joined so that the first panel and second panel are in a V configuration, the first panel and second panel joined with one another at an apex, the first panel including a first panel distal end distal from the apex, the second panel including a second panel distal end distal from the apex;

a reference line extending though the apex;

a first extension wall extending from the first panel distal end, the first extension wall including a first extension wall proximal end adjacent the first panel distal end and a first extension wall distal end, the first extension wall extending parallel to the reference line;

a first sealer wall extending downward and transversely to the first extension wall; and a second extension wall extending from the second panel distal end, the second extension wall including a second extension wall proximal end adjacent the second panel distal end and a second extension wall distal end;

wherein the first extension wall includes a first extension wall inner surface facing toward a second extension wall inner surface of the second extension wall, and a first extension wall outer surface configured to face toward a first building surface when the elongated gap filler is placed between the first building surface and a second building surface, wherein the second extension wall includes a second extension wall outer surface configured to face toward a second building surface when the elongated gap filler is placed between the first building surface and the second building surface.

12. The elongated gap filler of claim 11, wherein the second extension wall extends arcuately upward from the second panel distal end a distance beyond the first extension wall.

13. The elongated gap filler of claim 11, wherein the second extension wall distal end is disposed a height above the second panel distal end.

14. The elongated gap filler of claim 13, wherein the distance is greater than the height, wherein the second extension wall is above the first extension wall, wherein the second extension wall extends farther from the second panel distal end than the first extension wall extends from the first panel distal end.

15. The elongated gap filler of claim 14 comprising:

an elongated filler strip disposed between the first extension wall inner surface and the second extension wall inner surface.

16. The elongated gap filler of claim 11, wherein the first extension wall extends a first distance from the first panel distal end, wherein the second extension wall extends a second distance from the second panel distal end, wherein the ratio of the second distance to the first distance is at least 2:1.

17. The elongated gap filler of claim 11, wherein the first sealer wall has a first radius of curvature with a first center located at least one of above and below the reference line, wherein the second extension wall has a second radius of curvature with a second center above the reference line.

18. A method of installing an elongated gap filler, the method comprising:

placing an elongated gap filler in a gap between a first surface and a second surface of a building such that a first panel and a second panel in a V configuration are within the gap, and such that a first extension wall extending at an obtuse angle from a distal end of the first panel is adjacent the first surface and such that a second extension wall extending from a distal end of the second panel is adjacent the second surface;

placing a first sealer wall extending transversely from the first extension wall against a third surface of the building that is substantially perpendicular to the first surface with the first sealer wall at least impairing the first and second panels from being inserted too far into the gap between the first and second surfaces;

moving the first and second panels relative to one another so that the first and second panels at least one of move toward one another and move away from one another to fit within the gap between the first surface and the second surface; and applying a wall covering to the first sealer wall so that the first sealer wall melds into the third surface.

19. The method of claim 18, wherein the first surface is an upper portion of a vertical wall, wherein the second surface is a horizontal surface above the vertical wall, spaced from the upper portion of the vertical wall by the gap, wherein the third surface is a vertical surface of the vertical wall, wherein the applying step incudes applying a filler material over a lower edge of the first sealer wall and over the vertical surface.

20. The method of claim 19, wherein the first extension wall extends a first distance from the first panel distal end, wherein the second extension wall extends a second distance from the second panel distal end, wherein the ratio of the second distance to the first distance is at least 2:1, wherein the second extension wall is arcuate and bends when the second extension wall is placed adjacent the horizontal surface.

* * * * *